United States Patent [19]

Ando

[11] Patent Number: 4,502,002

[45] Date of Patent: Feb. 26, 1985

[54] ELECTROSTATICALLY OPERATED DUST COLLECTOR

[75] Inventor: Takashi Ando, Kobe, Japan

[73] Assignee: Mitsubishi Jukogyo Kabushiki Kaisha, Tokyo, Japan

[21] Appl. No.: 413,984

[22] Filed: Sep. 2, 1982

[51] Int. Cl.[3] ..... B03C 3/68

[52] U.S. Cl. ..... 323/237; 323/903; 55/105

[58] Field of Search ..... 323/237, 241, 903, 320, 323/322; 55/104, 105; 361/235

[56] References Cited

U.S. PATENT DOCUMENTS

| | | | |
|---|---|---|---|
| 3,984,215 | 10/1976 | Zucker | 323/903 X |
| 4,061,961 | 12/1977 | Baker | 323/903 X |
| 4,267,502 | 5/1981 | Reese et al. | 323/237 |

*Primary Examiner*—Peter S. Wong

*Attorney, Agent, or Firm*—Toren, McGeady and Stanger

[57] ABSTRACT

An improved electrostatically operated dust collector is disclosed which includes a high voltage power supply circuit by way of which a direct current having high voltage fed from a commercial power supply network is applied thereto and a control circuit for controlling said high voltage power supply circuit. The improvement consists in that the dust collector further includes an intermittently operative electric power feed circuit in which feeding of DC electric power thereto is effected for a period of time $T_1$, then feeding of electric power is intermitted for a period of time $T_2$. The aforesaid steps are repeated. A preset circuit also forms part of the improvement in which circuit the aforesaid feeding time $T_1$ and no-feeding time $T_2$ are preset to a required value respectively. An intended energy saving is ensured by the improvement.

3 Claims, 9 Drawing Figures

ELECTROSTATICALLY OPERATED DUST COLLECTOR

FIELD OF THE INVENTION

The present invention relates to an improved electrostatically operated dust collector (hereinafter referred to simply as duct collector).

BACKGROUND OF THE INVENTION

To facilitate understanding of the present invention, a typical conventional dust collector will be briefly described below with reference to FIG. 1 which schematically illustrates the structure thereof by way of a block diagram. The conventional dust collector identified by reference numeral 1 includes a high voltage power supply source 2 in which an alternate current from a commercial power supply network is rectified to a direct current having high voltage and then the latter is supplied to the dust collector 1 and a control apparatus 3 in which a signal U is generated for the purpose of controlling the direct current having high voltage obtained in said high voltage power supply source 2.

The control apparatus 3 serves for controlling a charging voltage, that is, a direct current having high voltage obtained in the high voltage power supply source 2, for instance, with the aid of a sparking frequency control device or the like incorporated therein so as to keep a dust collecting efficiency at the highest level at all time. In some case where the dust collector has little fluctuation in functional characteristics, a charging voltage is manually controlled so that it is kept constant.

However, in any of the conventional dust collectors, control is effected for a charging voltage so as to keep a dust collecting efficiency at the highest level at all times. Thus, in some cases, there is a necessity for raising up the dust collecting efficiency in excess of a required level, resulting in wasteful consumption of electric power which is undesirable from a viewpoint of energy saving.

In view of the background with respect to the conventional dust collectors as described above, a modified system for collecting dust without a necessity for raising up a dust collecting efficiency higher than a required level was proposed for the purpose of preventing wasteful consumption of electric power. The modified system is schematically illustrated in FIG. 2 in the form of a block diagram and it is constructed such that a dust density measuring device 6 is disposed at the outlet of the dust collector 1 so as to keep a dust density at a constant level at all time by controlling a charging voltage with the aid of the control apparatus 3 adapted to generate a control signal U having an intensity A as illustrated in FIG. 3(A).

In fact, the present invention is concerned with an improvement with respect to the above modified system.

SUMMARY OF THE INVENTION

Thus, it is an object of the present invention to provide an improved electrostatically operated dust collector which ensures an intended energy saving by way of the steps of transforming a control signal U having a constant intensity A to a shape of a number of pulses having a certain period as illustrated in FIG. 3(B) and then allowing charging and no-charging to continue alternately. Specifically, the present invention is directed toward an electrostatically operated dust collector of the kind including a high voltage power supply circuit by way of which a direct current having high voltage supplied from a commercial power supply network is applied thereto and a control circuit for controlling said high voltage power supply circuit, wherein the dust collector further includes an intermittently operative electric power feed circuit in which feeding of DC electric power thereto is effected for a period of time $T_1$, then feeding of electric power is intermitted for a period of time $T_2$ and the aforesaid steps are repeated subsequently and a preset circuit in which the aforesaid feeding time $T_1$ and no-feeding time $T_2$ are preset to a required value respectively.

Other objects and advantageous features of the present invention will be readily understood from the reading of the following description made in conjunction with the accompanying drawings.

BRIEF DESCRIPTION OF THE DRAWINGS

The accompanying drawings will be briefly described as follows.

Now the present invention will be described in more details with reference to the accompanying drawings which illustrate a preferred embodiment of the invention.

DESCRIPTION OF THE PREFERRED EMBODIMENTS

Figure 1:
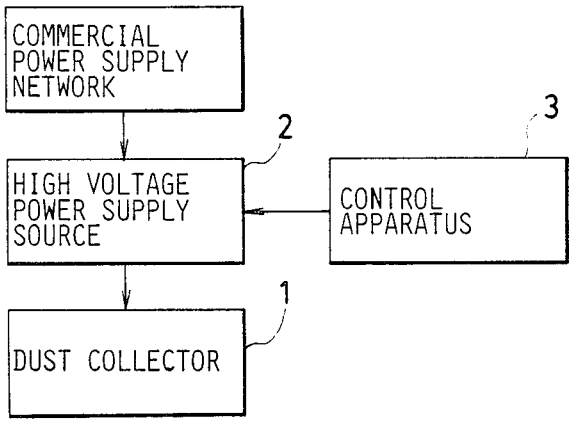
FIG. 1 is a block diagram schematically illustrating a typical conventional dust collector.
Figure 2:
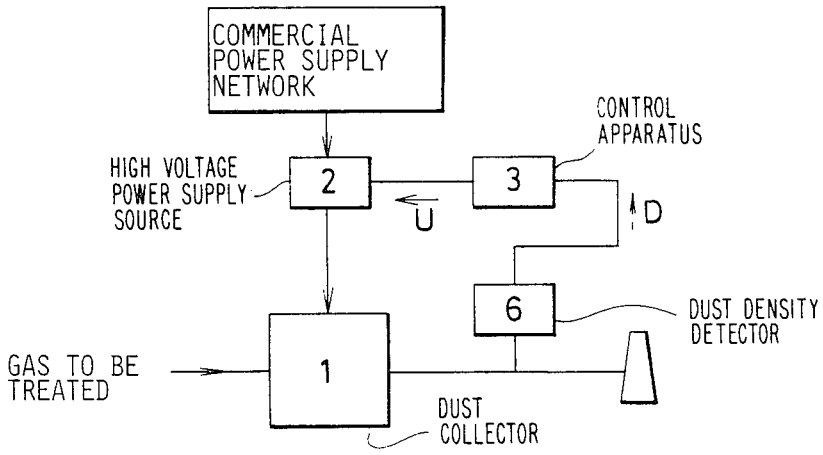
FIG. 2 is a block diagram schematically illustrating another conventional dust collector modified from that in FIG. 1.
Figure 4:
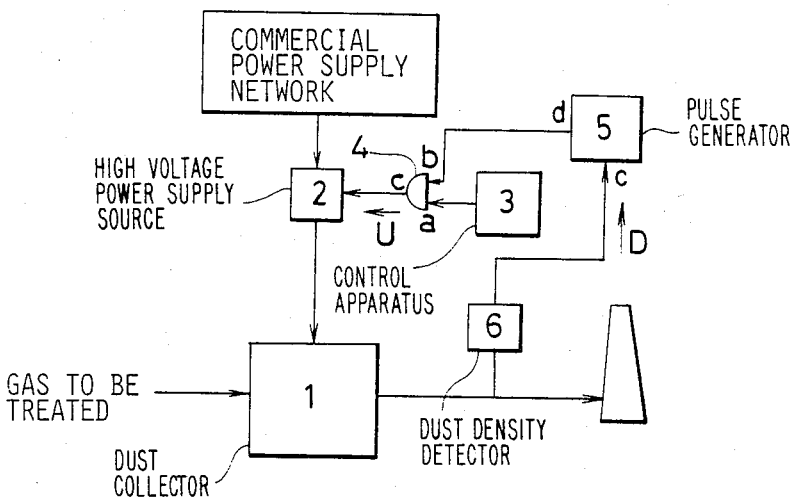
FIG. 4 is a block diagram schematically illustrating a dust collector in accordance with a preferred embodiment of the present invention.
Figure 5:
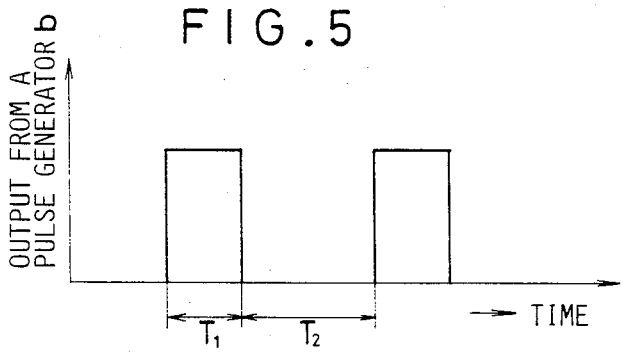
FIG. 5 is an illustration representing a wave form of an output from a pulse generator in FIG. 4.

First, it should be noted that the same components shown in FIG. 4 as those in FIGS. 1 and 2 are identified by the same reference numerals as those in the latter. In FIG. 4 reference numeral 4 designates a gate circuit which includes two inputs a and b and one output c and is constructed such that the input a is outputted in the form of an output c when the input b is inputted but the output c is zero as long as the input b is zero. Reference numeral 5 designate a pulse generator adapted to output a pulse having a time width $T_1$ as a gate signal at a period $T_1+T_2$ as shown in FIG. 5. The time widths $T_1$ and $T_2$ are determined by the input a, that is, an output signal D from a dust density measuring device 6 in the following manner.

Specifically, the pulse generator 5 has a control function which is effective in decreasing the time width $T_1$ or increasing the time width $T_2$ as the output signal D is at a low level which means that the dust density is reduced. In this case a ratio $T_1/(T_1+T_2)$ is decreased. On the contrary, the ratio $T_1/(T_1+T_2)$ is increased when the output signal D is at a high level. For instance, as the output signal D varies in the range of 0 to 100%, the ratio $T_1/(T_1+T_2)$ varies in the range of 1 to 0.02 by changing the time width $T_2$ from 0 to 500 ms on the assumption that the time width $T_1$ is preset to 10 ms.

The input a to the gate circuit 4 is obtained from an output from a conventional control circuit 3 as schematically shown in FIG. 1. It should be noted that it is convenient that the pulse generator 5 is constructed such that the time widths $T_1$ and $T_2$ can be manually determined when a trouble or failure takes place with the dust density measuring device 6 or there is little fluctuation in functional characteristics.

In the dust collector of the above-described kind the control apparatus 3 has an output U as illustrated in FIG. 3(B). The pulse has a height A which is same to that of an output from the conventional control apparatus 3. However, due to the fact that the time widths $T_1$ and $T_2$ are determined by the output signal D from the dust density measuring device 6 or are manually determined it is found that the charging time ratio $T_1/(T_1+T_2)$ relative to a single period is decreased as a dust collecting efficiency is increased and thereby a dust density at the outlet of the dust collector is decreased but the dust collecting efficiency is decreased and thereby the dust density at the outlet of the dust collector is increased as the charging time $T_1$ is shortened. On the contrary, the dust collector functions in the reverse manner when the dust density is decreased. As will be readily understood from the above description, the dust collector is operated such that no electricity is consumed during the period of time $T_2$ in which no electrical charging is effected while the required value of dust density is maintained. Thus, the intended object of energy saving can be satisfactorily accomplished.

Figure 6:
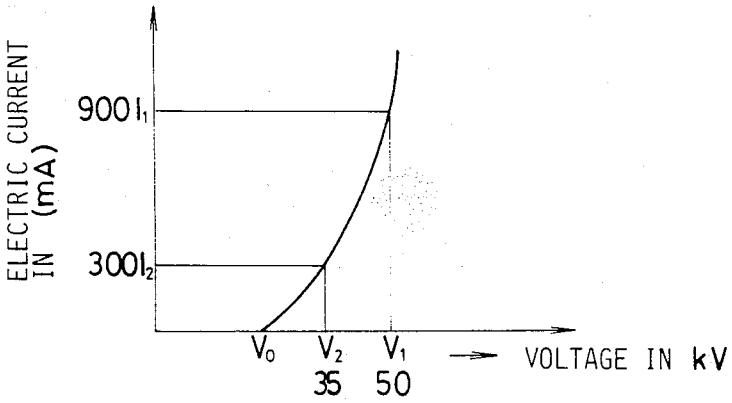
FIG. 6 is a diagram representing functional characteristics with respect to a relation between voltage and electric current in the dust collector.

Generally, a relation between voltage V and electric current I in the dust collector is such that electric current I starts its flowing only when corona initiating voltage $V_o$ is reached and it increases steeply as voltage V increases, as illustrated in FIG. 6.

It should be noted that the larger a product of a peak voltage $V_p$ and an average voltage $V_{av}$ is, the higher the dust collecting efficiency becomes.

Figure 3:
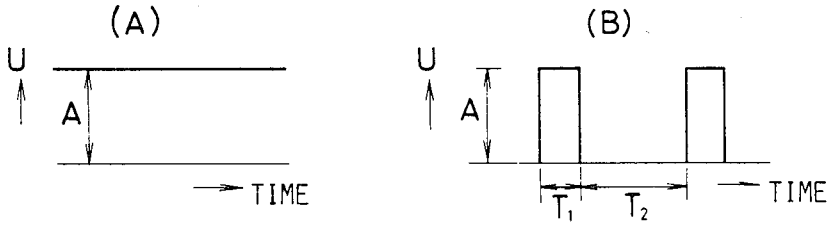
FIG. 3(A) is an illustration representing a wave form of a control signal U in FIG. 2.
FIG. 3(B) is another illustration representing a wave form of a control signal in FIG. 2 which is outputted in the form of pulses.

Provided that the dust collector is operated with a charging voltage in conformance with a control signal issued from the modified system as illustrated in FIG. 3 (A) under an operating condition defined by voltage $V_1$ and electric current $I_1$, an equation $V_1 \cdot V_{av}=V_1^2$ is established. Since consumed electric power is represented by an equation $W=I_1 \cdot V_1$, the result is such that $V_p \cdot V_{av}=50\times 50=2500$ and $W=0.9\times 50=45$ KW are obtained in case of $I_1=900$ mA and $V_1=50$ kV.

Next, when reducing electric current I to one third, that is, to 300 mA, equations $V_p \cdot V_{av}=V_2^2$ and $W=I_2 \cdot V_2$ are established. Thus, the result is such that $V_p \cdot V_{av}=1225$ and $W=0.3\times 35=10.5$ W are obtained for instance in case of $V_2=35$ kV.

Figure 7:
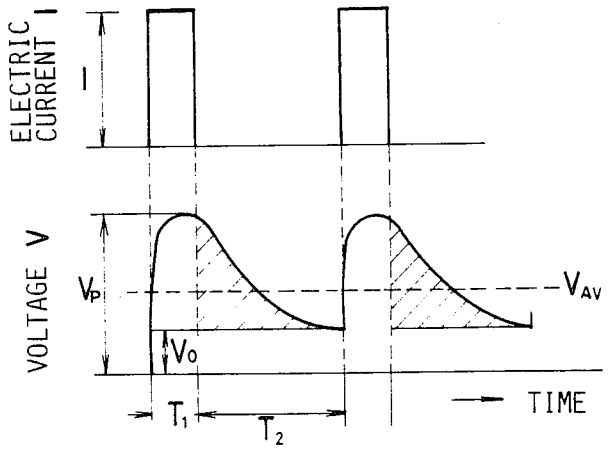
FIG. 7 is diagrams representing a wave form of voltage and electric current in the dust collector in FIG. 4.

On the other hand, since the dust collector in accordance with the present invention is constructed so as to use a pulse-shaped control signal U as illustrated in FIG. 3(B), voltage V and electric current I vary in such a manner as illustrated in FIG. 7. Thus, assuming that electric current $I_1$ has 900 mA for a period of charging time $T_1$ which corresponds to the foregoing example of operation in accordance with the aforesaid modified system where electric current I has 900 mA, a peak value of voltage $V_p$ is represented by $V_p=V_1=50$ kV as is apparent from FIG. 6. Further, when obtaining the time width $T_2$ in which the same electric power is consumed as that of the foregoing example of operation where electric current I is reduced to one third, that is, 300 mA on the assumption that the time width $T_1$ has, for instance, 10 ms, the following equation is established.

$$W = V_p \cdot I_1 \cdot T_1/(T_1 + T_2) = 50 \times 0.9 \times 10/(10 + T_2)$$
$$= 10.5 \text{ kW}$$

Thus, $T_2=33$ ms is obtained from the above equational relation.

Specifically, when assuming that the dust collector in accordance with the present invention is operated under such a condition as $T_1=10$ ms and $T_2=33$ ms, the result is that the same electric power is consumed as the foregoing example of operation in accordance with the aforesaid modified system where a consumed electric power is 10.5 kW. In this case there occurs no steep decrease in $V_o$ owing to the existence of capacitance of the dust collector as illustrated by hatching lines in FIG. 7, even though electric current at voltage V is intermitted for a period of time width $T_2$. Accordingly, an average value of voltage $V_{av}$ has no substantial decrease irrespective of intermitted period of time $T_2$. This average value of voltage varies in dependence on the structure of the dust collector and its operating conditions and thus it cannot be determined even though the functional characteristics as illustrated in FIG. 6 are predetermined. However, in case that $V_{av}$ has for instance 27 kV, a product $V_p \cdot V_{av}=50\times 27=1350$ is obtained. This means that an improved dust collecting efficiency as represented by $V_p \cdot V_{av}=(1350-1225)/1225=10\%$ is ensured at the same consumption of electric power as the aforesaid example of operation in accordance with the modified system where electric current I is reduced to one third.

Figure 8:
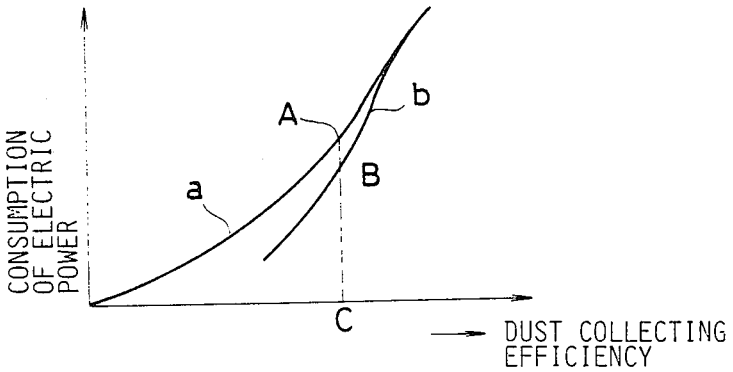
FIG. 8 is a diagram representing functional characteristics with respect to a relation between dust collecting efficiency and consumption of electric power, wherein a characteristic curve a represents functional characteristics of the dust collector in accordance with the modified system as illustrated in FIG. 2, while a characteristic curve b does those of the dust collector constructed in accordance with the present invention.

It is revealed by experiments that a relation between consumed electric power and dust collecting efficiency is established in such a manner as illustrated in FIG. 8. In the drawing, a characteristic curve a represent a relation therebetween in accordance with the aforesaid modified system in FIG. 3(A), while another characteristic curve b does that in accordance with the present invention. It will be readily confirmed that to obtain a certain dust collecting efficiency c the dust collector in accordance with the conventional modified system requires a power consumption as identified by reference letter A but that in accordance with the present invention does merely B whereby a saving in consumed electric power corresponding to A - B is ensured by employment of the present invention.

Since the dust collector in accordance with the present invention is constructed such that it includes a high voltage power supply circuit by way of which a direct current having high voltage fed from a commercial power supply network is applied thereto and a control circuit for controlling said high voltage power supply circuit, wherein the improvement consists in that it further includes an intermittently operative electric power feed circuit in which feeding of DC electric power to the dust collector is effected for a period of time $T_1$, then feeding of electric power is intermitted for a period of time $T_2$ and the aforesaid steps are repeated and a preset circuit in which the aforesaid feeding time $T_1$ and no-feeding time $T_2$ are preset to a required value respectively, it is ensured that an excellently high energy saving is achieved for it. Thus, it can be concluded that very useful industrial benefits are provided by the present invention.

It should be of cource understood that the present invention should be not limited only to the preferred embodiment as illustrated in the accompanying drawings and a variety of changes or modifications may be made by those skilled in the art without any departure from the spirit and scope of the present invention.

What is claimed is:

1. An electrostatically operated dust collector comprising a high voltage power supply circuit on which is taxed a direct current of high voltage fed from a commercial power supply and a control circuit for controlling said high voltage power supply circuit, the dust collector further including a dust-density measuring device, a pulse generator capable of transmitting a pulse as a gate signal for a width of time $T_1$ for a period of time, $T_1+T_2$, so that when the dust density detected by said dust-density meansuring device is decreased, $T_1/(T_1+T_2)$ can be reduced and when it is increased, said $T_1/(T_1+T_2)$ can be increased, and a gate circuit for transmitting an input from said control circuit to said high voltage power supply circuit while said pulse for said width of time is being transmitted as said gate signal.

2. In an electric dust collector having a low voltage power supply driving a high voltage power supply which drives dust collecting electrodes, a control circuit and pulse generator operatively coupled to the high voltage power supply for developing a periodic pulsed D.C. signal of predetermined pulse repetition rate and constant maximum and minimum voltage levels, the improvement comprising:

a dust density measuring means for developing a control signal which is representative of the density of dust in a surrounding environment; and said pulse generator being responsive to said control signal of the dust density measuring means for developing a periodic pulsed signal of predetermined pulse repetition rate, the ratio of the pulse width to the total period of said pulsed signal being lower for low dust densities and higher for high dust densities so that the total electrical energy applied to said electrodes is conserved.

3. The dust collector of claim 2, including manual means to select the ratio of the pulse width to the total period of said pulsed signal.

* * * * *